United States Patent [19]

Powell et al.

[11] 4,393,598

[45] Jul. 19, 1983

[54] BOREHOLE TOOL

[75] Inventors: Steven W. Powell; James G. Stockton, both of Houston, Tex.

[73] Assignee: NL Sperry Sun, Inc., Sugar Land, Tex.

[21] Appl. No.: 369,400

[22] Filed: Apr. 19, 1982

Related U.S. Application Data

[63] Continuation of Ser. No. 115,454, Jan. 25, 1980, abandoned.

[51] Int. Cl.[3] ..... E21B 47/00

[52] U.S. Cl. ..... 33/302; 33/312; 33/314; 33/357; 324/221; 324/225

[58] Field of Search ..... 33/302, 304, 305, 311, 33/312, 313, 314, 356, 357; 324/221, 225; 307/2, 26, 22

[56] References Cited

U.S. PATENT DOCUMENTS

| | | | |
|---|---|---|---|
| 2,703,053 | 3/1955 | Castel | 307/26 X |
| 2,940,177 | 6/1960 | Bricaud | 33/313 |
| 3,588,908 | 6/1971 | Lindsey | 33/314 |

FOREIGN PATENT DOCUMENTS

| | | | |
|---|---|---|---|
| 559456 | 3/1957 | Italy | 33/314 |

*Primary Examiner*—William D. Martin, Jr.

*Attorney, Agent, or Firm*—W. E. Johnson, Jr.; D. L. Traut

[57] ABSTRACT

A surface activated multishot survey tool utilizes a dampened magnetic compass movably positioned within a probe to determine the direction of a borehole. Lamps in the probe are operable to light the face of the compass. A lens projects the image of the compass onto a movable film strip. An electrical cable is connected to the probe and is used to pass a current to the lamps and provide selective operation of the tool from the surface of the borehole. Electrical connectors are provided at each end of the probe so that the probe may be inverted within the borehole to accommodate surveys in which the angle of the borehole is greater than that at which the compass will operate without error. Because connectors are located at both ends of the probe, electrical current passes around the magnetic compass, thus creating a magnetic field about the compass. An alternating current is used to operate the tool, with the rate of change in direction of the current being faster than the movement response time of the dampened compass to the changing magnetic field generated by the current.

8 Claims, 2 Drawing Figures

BOREHOLE TOOL

This is a continuation of application Ser. No. 115,454, filed Jan. 25, 1980, now abandoned.

BACKGROUND OF THE INVENTION

The present invention pertains to a borehole tool and more particularly to a magnetic compass device which is capable of directional surveys of a borehole having angular changes up to 180° in a vertical direction.

When making drill holes in the ground, particularly drill holes which run partly through rock and partly through less consolidated earth layers, it often happens that the dip or inclination of the drill hole in the horizontal plane as well as the direction of the hole will vary quite considerably at different depths of the hole. In many cases, therefore it is very important to determine the existing deviations from a desired inclination and direction and in addition it is often desirable to survey the complete traverse of an uncased hole. One such situation occurs when it is desirable to determine the true vertical depth of a hole in order, for example, to locate a geological formation relative to the well depth. A complete survey of the borehole traverse is also desirable for the purpose of a "check survey," used to determine if a directionally drilled hole is located at its intended position. However, the most common use for the so-called "multishot" directional survey is to determine the exact bottom hole location or the path of the wellbore. A survey of the path may be used to pick out an optimum point in the wellbore to start the deflection of a directionally drilled hole. Defining the bottom hole location would have applications to many situations as, for example, to determine where the hole bottom is located relative to a stratigraphic feature of a formation, or even for legal purposes.

One apparatus which has been used for the purposes outlined above is termed a multishot magnetic directional survey instrument. Such an instrument is used to obtain a running record of the inclination and the direction of inclination at various depths in a borehole. The instrument may be used for the purpose of orienting a hole in directional drilling operations, and also to chart the course of boreholes from surface to total depth during a normal drilling operation. The directional features of the instrument consist of a magnetic compass. The inclination unit is a form of inverted plumbob. These two features are combined into a single compass angle unit which may be available in various ranges of degrees of inclination. The compass angle unit is normally comprised of a floating magnetic needle designed so that its directional and angular positions may be simultaneously photographed and recorded on a film strip. A movie camera unit in the instrument makes a permanent record of the compass angle unit reading as it traverses the borehole. Electrical power to operate lamps in the camera unit may be furnished by batteries or by a conductor cable suspending the instrument from the earth's surface. Further details of a multishot survey instrument are found in U.S. Pat. No. 3,588,908.

One application for borehole surveys which is particularly pertinent to the present invention is that of mining boreholes. In uranium mining operations, small diameter boreholes, or "fan" holes, are made into earth formations into which are run gama probes. After shafts are sunk and mining begins, a certain amount of exploration is conducted both to determine the extent of ore present and also to find hidden ore bodies. Typically, these holes are drilled from an underground cave into its walls, overhead, and back to horizontal on the opposite side. One "fan" consists of approximately twelve holes. There is no control used in the drilling process to reach an objective target. Instead holes are allowed to drift at will. The holes are dug from between 200 ft. to 500 ft. deep.

After a fan is completed, logging operations are used to probe the holes, gathering a log of gamma count correlated to its depth. Because of the random wandering of the borehole and the expensive cost of drilling the ore (estimated at $1,000 per foot), surveying has become a necessity for accurate location of ore bodies.

The present methods used in logging and surveying fan holes are as follows: Crews of two men begin on a series of fan holes by inserting a logging probe using five foot sections of aluminum push rods. The hole is logged by the probe as rods are pulled from the bore. A conductor line is used for transmission of data from the probe to a display readout at the operator's console. A self-contained 24-volt power supply is used to run the probe. Using the presently available battery powered multishot survey instrument and circuit breakers during the gamma logging process causes the operator to have to wait for a minimum of 35 seconds at a survey station to obtain a record. The battery powered multishot continuously records the position of the compass on film at intervals selected by a switch on one end of the tool. Intervals are available from 15 seconds to 32 minutes. To insure a good record at a particular depth, it is first necessary to allow the compass to stabilize. This takes approximately 10 seconds. Then to insure a photograph is taken at the location after the compass is stabilized, the operator must wait 15 seconds for the lamps to start to be activiated. After the lamps are activated, it takes approximately 10 seconds to obtain an adequate exposure of the film. This waiting time delays the total process sufficiently that in surveying uranium mines, the survey itself has been separated from the logging process and run alone subsequent to the logging of a fan. The total process of two runs, one for logging and one for surveying, has presented significant problems in the amount of personnel required and effectiveness of the survey.

Needed is a survey instrument which can be activated from the surface thereby eliminating the waiting time required in obtaining a survey record. Thus the log and directional survey can be done on one trip in the hole, and total time cut in half.

One solution to the above-mentioned problem is a system having the instruments, lights, and solenoid advance powered from the surface using conductor wires. This method has proven only partially successful. By using a compass capable of tilting up to 120° from vertical, holes surveyed in this fashion cannot exceed 20° above horizontal (120° from vertical). When using a standard battery powered multishot, the instrument can be inverted in its protective case eliminating this problem. However, when using a surface-activated multishot, the instrument requires a conductor wire running along side the instrument when it is inverted, and this wire creates a magnetic field affecting the compass reading when current is applied to power the lights.

Some of the more obvious solutions which have been advanced to solve this problem are as follows:

(a) To use some type of shielding device around the compass itself preventing magnetic interference.

This would necessitate a change in the compass shell or an additional magnetic barrier which cannot be incorporated because of size limitations, particularly tool diameter, due to the small diameter ($1\frac{3}{8}$") of a "fan" hole.

(b) The possibility of building a 180° compass unit. Because of design and engineering problems involved, this method also appears to be impractical.

(c) The use of a time delay circuit which would allow the current passing by the compass to be stored in a series of capacitors at the solenoid end of the instrument and then released to power the lights at a predetermined delay period after the compass has come to rest from its electrical current interference. Again, such a system would get into space, electronic complexity, and time delay problems.

It is therefore an object of the present invention to provide a simple system meeting the physical space requirements of a small diameter tool housing for directionally surveying holes up to 180° from vertical and being surface activated.

SUMMARY OF THE INVENTION

With this and other objects in view, the present invention utilizes in a borehole instrument, an instrument housing having electrical connectors at both ends thereof and a magnetically responsive member in the housing for detecting direction. Some method of dampening the magnetically responsive member is employed to slow the response time of the magnetically responsive member in changing its state due to the effect of an alternating current in its physical proximity. An alternating current is provided from the surface to a photographic recording system in the housing to actuate the recording system when it is desired to record the position of the tool within a borehole. The rate of change of alternations in the current is chosen such that it exceeds the rate at which the magnetically responsive member is affected by the alternating current, thereby providing a zero average magnetic field due to the current alternations, leaving the earth's magnetic field as the remaining net magnetic effect on the magnetically responsive member.

DESCRIPTION OF THE PREFERRED EMBODIMENTS

Figure 1:
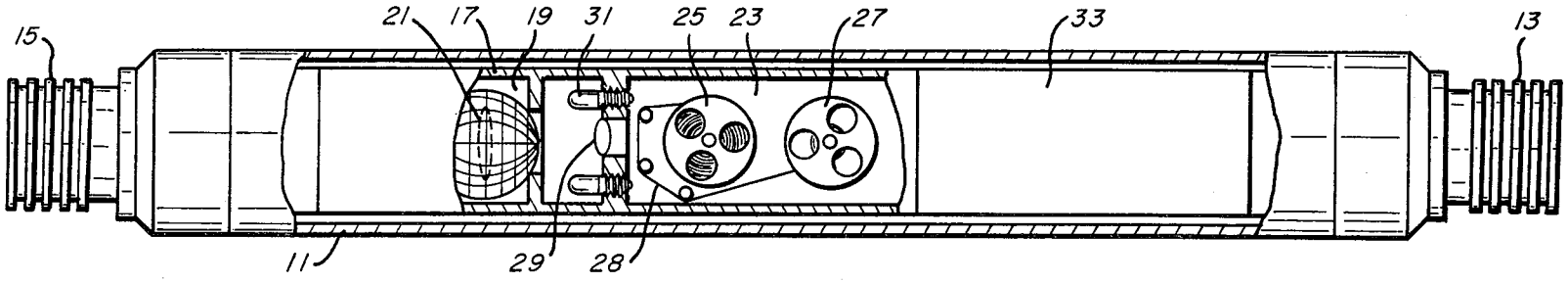
FIG. 1 is a schematic illustration of an instrument for utilizing principles of the present invention.

Referring first to FIG. 1 of the drawings, a borehole surveying instrument is shown including a protective case or housing 11 with threaded end couplings 13 and 15 at its upper and lower ends respectively as viewed in FIG. 1. The end couplings have integral wiring members for providing electrical connection to a conductor cable. An instrument case 17 is mounted concentrically within the housing and is insulated therefrom with sealing members such as rubber O rings (not shown). A lower chamber 19 within the case houses a magnetic compass angle unit 21 which is pivotally floated in a fluid in the chamber 19. Indicia on the head of the compass angle unit provides a visual indication of the direction and inclination of the tool housing. The buoyancy of the fluid in the chamber 19 maintains the compass angle unit in a vertical position on its pivot (not shown). The viscosity of the fluid within the chamber 19 provides a dampening effect to the movement of the compass angle unit on its pivot in the chamber in response to magnetic influence.

A chamber 23 within the case houses film take-up and supply reels 25 and 27 respectively for advancing photographic film 28 over a lens 29 mounted between 19 and 23. Lamps 31 are also mounted on a partition between the chambers and are arranged to direct light emanating therefrom toward the compass angle unit 21. Another section 33 within the instrument case houses the film advance circuitry and motor mechanisms (not shown).

Figure 2:
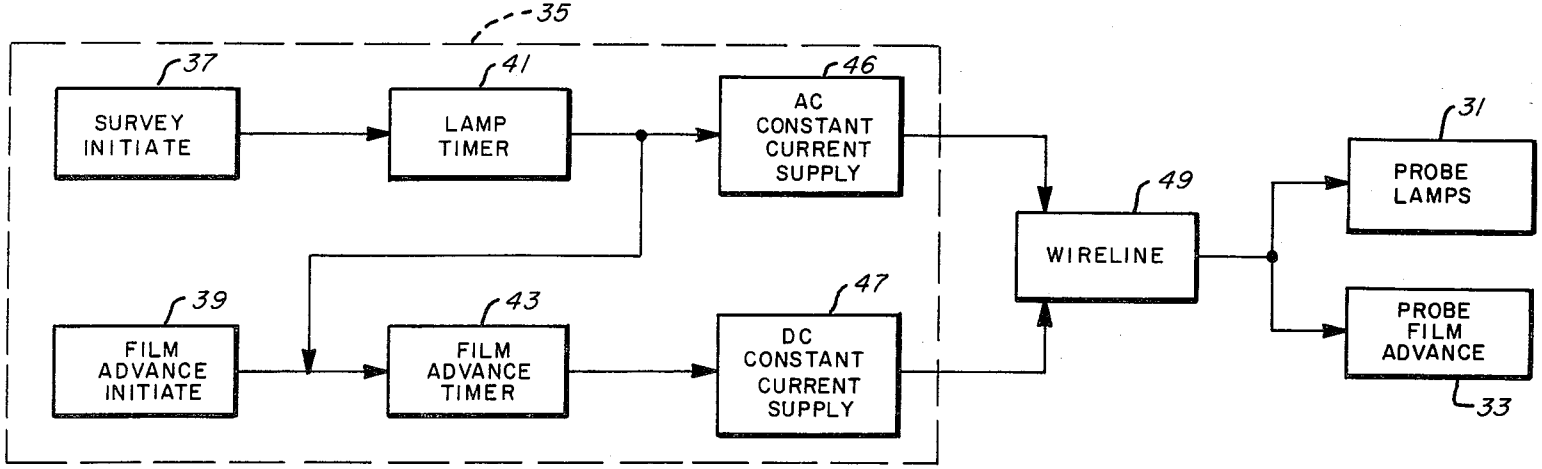
FIG. 2 is a schematic block diagram of the electrical system used in conjunction with the present invention.

Referring now to FIG. 2 of the drawings, a simplified schematic diagram shows the essential circuit elements for operating the apparatus of FIG. 1. A surface unit 35 includes switches 37 and 39 for controlling operation of the lamps and film advance, respectively. A lamp timer 41 provides a means for automatically timing the survey cycle. For a normal cycle the switch 37 is depressed momentarily and released and the lamp will then be timed on for a preselected time period, to expose the film 28. Likewise a film advance timer 43 is operated at the end of the timer 41 operation to advance film for the next recording. The switch 39 may be used to manually operate the timer 43 and thereby advance film without taking a picture in order to mark an event during a survey on a particular section of the film. The timer 41 operates to pass a signal from a constant current AC power supply 45 over a wireline 49 to the lamps 31 in the probe. The AC power supply 45 is comprised of a DC power supply, two power-switching transistors, and associated circuitry to limit peak current and thereby provide a constant average absolute value of current on its square wave output. The constant current power supply to the lamps provides a consistent film exposure over a wide range of wireline lengths, wherein the variations in wireline length vary the voltage drop on the line.

An alternating current power supply is used for the following reasons: Theoretically, a DC power signal, when uniformly passed in a concentric cylindrical case around the compass, should provide zero magnetic effect on the compass. However, it is found that error is introduced by slight eccentricity or when anomalies in the metallic structure of the concentric cylindrical case 17 produce hot spots which generate an asymmetric magnetic field and thus introduce errors. Such errors may be of a magnitude that is greater than that desirable for the accuracy needed in such surveys.

The film advance timer 43 operates to couple a DC constant current power supply 47 with the film advance mechanism 33. The timer 43 and DC supply starts and stops the film advance mechanism after the lamps have operated, and thus any magnetic interference takes place after film exposure. Also, magnetic interference caused by the DC film advance will serve to jiggle the compass angle unit 21 and prevent sticking on the compass pivot.

In a survey, the multishot survey tool is placed on the end of the probe assembly. In mining applications, for example, a gamma probe or similar device may be connected to the survey tool and behind the survey tool in the assembly. Power to the survey tool is passed by conductor paths in the gamma probe from the wireline to the connector plugs 13 or 15 on the survey tool ends. The assembly is then connected to the end of a 5' aluminum push rod. Successive rods are then connected in the probe assembly string as the probe assembly is inserted deeper into the fan holes. This procedure is repeated until the end of the probe assembly is positioned as far in the fan hole as desired and the survey is begun. Successive records are made on the film, by activating the switch 37 at the surface of the fan hole, as the rods are successively removed from the fan hole. If the holes have deflected to such an extent that they exceed an angle of more than the operational limits of the compass angle unit, i.e. 120° from the vertical, then in order to complete the survey, the multishot survey probe is removed from the hole and reversed 180° in the tool string. This is accommodated by the end couplings 13 and 15 at both ends of the tool housing. The survey is then continued with further reversal taking place when appropriate.

The end couplings 13 and 15 being located at both ends of the tool are responsible for the need to pass the electrical current conductor paths around the compass angle unit. By providing an alternating or direction-changing current to the lights in the probe, the magnetic field generated by the current is reversed periodically to provide a zero average magnetic field. If the rate of reversal of current is such that it exceeds the movement response time of the measuring device, i.e. the magnetic compass, to the changing field; then the compass does not have time to physically react to the field before it changes direction (polarity) 180°. The dampening of the compass movement, such as by viscosity of fluid in chamber 19 in the present embodiment, further facilitates this process.

The above disclosure has been primarily directed to the use of a magnetic compass survey unit. It is apparent that other instruments for use in a borehole would be susceptible to use within the bounds of this disclosure, such as other magnetically operated apparatus. In addition, while this disclosure is also primarily directed to a survey in uranium mining operations, it is apparent that other borehole applications would find use for the device.

Therefore, while particular embodiments of the present invention have been shown and described, it is apparent that changes and modifications may be made without departing from this invention in its broader aspects, and it is the aim in the appended claims to cover all such changes and modifications which fall within the true spirit and scope of this invention.

What is claimed is:

1. An apparatus for measuring a borehole parameter comprising:

(a) an elongated housing having first and second ends;

means for supply alternating electrical power to said housing at either of said first or second ends, said means including at least one electrical conductor running between said first and second ends; (at either end to permit inversion of the housing in the borehole);

means within said housing for detecting a borehole parameter, said detecting means being activated in response to changes in the parameter being detected, said detecting means also being activated in response to the passage of an electrical current creating a magnetic field within the immediate environment of said detecting means;

means for dampening the response of said detecting means and thereby slowing down the response time of said detecting means to the magnetic field created by said electrical current; and means for varying the direction of electrical current supplied to said housing at a rate faster than the response time of said detecting means when subjected to the electrical current, thereby providing a zero average magnetic field.

2. The apparatus of claim 1 wherein said detecting means is movably mounted within said housing.

3. The apparatus of claim 2 wherein said detecting means is a compass movably mounted within said housing.

4. The apparatus of claim 1 wherein said detecting means is a magnetic device and said power supply means provides an AC current having a rate faster than the response time of the magnetic device.

5. A method of surveying the direction of a borehole comprising the steps of:

passing a survey probe including a magnetic field measuring device into a borehole;

dampening the response time of the magnetic field measuring device as the device responds to changes in magnetic fields associated with the probe; and supplying an electrical current to one end of the probe, with the electrical current changing direction at a rate faster than the response time of the dampened magnetic field measuring device to the changes in the magnetic fields due to such electrical current.

6. The method of claim 5 and further including:

recording the position of the magnetic field measuring device with respect to a fixed reference;

sending the electrical current to lamps within the probe to turn on the lamps; and photographing the magnetic field measuring device to record the orientation of the device with respect to such fixed reference.

7. An apparatus for measuring a borehole parameter comprising:

an instrument housing;

electrically operated recorder means within said housing;

magnetic responsive means within said housing for measuring a borehole parameter;

electrical conductor means passing to both ends of said housing and within the magnetic field proximity of said measuring means;

power supply means electrically connected to said conductor means for supplying an alternating current to said instrument housing; and means changing the direction of said alternating current at a rate exceeding the response rate of said magnetic responsive means to changes in the magnetic field in the magnetic field proximity of said measuring means due to the passage of an electrical current.

8. A method of surveying an earth borehole, comprising:

supplying an alternating electrical current to the first end of a survey probe and thereafter making a first pass of said probe through the said borehole to thereby generate first signals indicative of a survey characteristic;

removing the said probe from the said borehole;

supplying an alternating electrical current to the second end of said survey probe and thereafter, with the said probe inverted from its position during the first pass through the borehole, making a second pass of said probe through the said borehole to thereby generate second signals indicative of a survey characteristic; and combining said first and second signals to provide a survey of said earth borehole.

* * * * *